US007753038B2

(12) United States Patent
Nakao et al.

(10) Patent No.: US 7,753,038 B2
(45) Date of Patent: Jul. 13, 2010

(54) IGNITION COIL

(75) Inventors: Kengo Nakao, Kariya (JP); Norihito Fujiyama, Obu (JP)

(73) Assignee: Denso Corporation, Kariya (JP)

( * ) Notice: Subject to any disclaimer, the term of this patent is extended or adjusted under 35 U.S.C. 154(b) by 415 days.

(21) Appl. No.: 11/822,929

(22) Filed: Jul. 11, 2007

(65) Prior Publication Data

US 2008/0022984 A1 Jan. 31, 2008

(30) Foreign Application Priority Data

Jul. 26, 2006 (JP) ..... 2006-203828
Feb. 6, 2007 (JP) ..... 2007-027153

(51) Int. Cl.
*H01F 38/12* (2006.01)
*H01F 27/34* (2006.01)

(52) U.S. Cl. ..... 123/634; 336/92

(58) Field of Classification Search ..... 123/634, 123/635; 336/60, 92, 96
See application file for complete search history.

(56) References Cited

U.S. PATENT DOCUMENTS 6,662,794 B2 * 12/2003 Nagata et al. ..... 123/634
6,809,621 B2 * 10/2004 Nagata et al. ..... 336/90
6,810,868 B2 * 11/2004 Tsunenaga et al. ..... 123/634
6,836,203 B2 * 12/2004 Wada ..... 336/198
6,897,755 B2 * 5/2005 Wada et al. ..... 336/90
7,222,616 B2 * 5/2007 Takeyama et al. ..... 123/634
7,501,923 B2 * 3/2009 Nakao et al. ..... 336/90
2002/0175796 A1 * 11/2002 Kawai et al. ..... 336/96
2002/0195092 A1 * 12/2002 Nagata et al. ..... 123/634
2003/0150440 A1 * 8/2003 Tsunenaga et al. ..... 123/634
2005/0242914 A1 * 11/2005 Kawai et al. ..... 336/90
2006/0021608 A1 * 2/2006 Takeyama et al. ..... 123/634
2006/0214758 A1 * 9/2006 Wada ..... 336/96
2007/0006858 A1 * 1/2007 Fontalba ..... 123/634
2007/0012301 A1 * 1/2007 Tauchi et al. ..... 123/634

FOREIGN PATENT DOCUMENTS

JP 8-100753 4/1996

OTHER PUBLICATIONS

U.S. Appl. No. 11/822,930, filed Jul. 2007, Nakao et al.

* cited by examiner

*Primary Examiner*—Stephen K Cronin
*Assistant Examiner*—Arnold Castro
(74) *Attorney, Agent, or Firm*—Nixon & Vanderhye PC

(57) ABSTRACT

An ignition coil is inserted into a plughole of an engine. The ignition coil includes a coil case accommodating a primary coil and a secondary coil, and extending to define a cylindrical mount portion on a high voltage side. The mount portion includes a high voltage terminal conductive with the secondary coil. A coil spring conducts the high voltage terminal with the sparkplug. A plug cap has a circumferential portion attached to the mount portion. The plug cap circumferentially surrounds the high voltage terminal, the coil spring, and the sparkplug. The mount portion has a substantially annular space communicating with an inner gap in the coil case, and charged with an infilling resin to have a first resin high voltage end located on the high voltage side with respect to a low voltage end of the circumferential portion of the plug cap on a low voltage side.

14 Claims, 3 Drawing Sheets

IGNITION COIL

CROSS REFERENCE TO RELATED APPLICATIONS

This application is based on and incorporates herein by reference Japanese Patent Applications No. 2006-203828 filed on Jul. 26, 2006 and No. 2007-27153 filed on Feb. 6, 2007.

This application is related to U.S. patent application Ser. No. 11/822,930 claiming priorities to the following Japanese Patent Applications, respectively:

No. 2006-203827 filed on Jul. 26, 2006; and

No. 2007-27152 filed on Feb. 6, 2007.

FIELD OF THE INVENTION

The present invention relates to an ignition coil.

BACKGROUND OF THE INVENTION

An engine is provided with an ignition coil having a coil main body constructed by, for example, coaxially arranging a primary coil with a secondary coil. The primary coil is constructed by winding a wire around a primary spool to form a primary winding, and the secondary coil is constructed by winding a wire around a secondary spool to form a secondary winding. A center core, which is formed of a magnetic material, is provided on the radially inner side of the primary and secondary coils. An outer core, which is formed of a magnetic material, is provided on the radially outer side of the primary and secondary coils. Thus, the center core and the outer core construct a magnetic circuit. The ignition coil has an inner gap charged with thermosetting resin such as epoxy resin to electrically insulate inner components from each other, and to fix the inner components therebetween.

The secondary coil has a high voltage end defining a plug mount portion to which a sparkplug is provided. The plug mount portion has a cap mount portion, which is in a cylindrical shape, and extends from a spool constructing the primary coil or the like. The cap mount portion is attached with a plug cap formed of rubber. The plug cap has a fitting hole accommodating a coil spring electrically conducted with a high voltage winding end of the secondary coil via the high voltage terminal. The sparkplug is mounted to the plug mount portion by fitting an insulator portion of the sparkplug into the fitting hole. The sparkplug has a terminal portion in contact with the coil spring.

For example, an ignition coil disclosed in U.S. Pat. No. 6,836,203 B2 (JP-A-2003-163126) has a cap mount portion having an annular charging portion, into which thermosetting resin is charged to restrict electric leakage from a high voltage terminal applied with high voltage to a plug hole in low voltage. This ignition coil disclosed in U.S. Pat. No. 6,836,203 B2 has a coil portion including the primary coil and the secondary coil inserted into a plughole of a cylinder head cover of an engine.

However, the above conventional structure of the ignition coil is not sufficient to restrict electric leakage from the high voltage terminal to the plughole. Specifically, high voltage applied to the high voltage terminal may be transmitted along the inner circumferential periphery of the annular charging portion, and further transmitted toward the radially outer side of the cap mount portion. Accordingly, in the conventional structure of the ignition coil, the insulation distance needs to be sufficiently secured to restrict electric leakage from the high voltage terminal to the plughole.

SUMMARY OF THE INVENTION

The present invention addresses the above disadvantage. According to one aspect of the present invention, an ignition coil for a sparkplug of an engine, the ignition coil including a coil main body including a coil case accommodating a primary coil and a secondary coil. The ignition coil further includes a plug mount portion provided to a high voltage end of the coil main body on a high voltage side. The coil case has an inner gap charged with an infilling resin. The plug mount portion and the coil main body are inserted into a plughole of the engine. The plug mount portion has a cap mount portion in a substantially cylindrical shape extending from a primary spool of the primary coil or the coil case. The cap mount portion is connected with a plug cap, which is formed of rubber, having a fitting hole into which an insulator portion of the sparkplug is inserted together with a high voltage terminal and a coil spring. The high voltage terminal is electrically conductive with a high voltage winding end of a winding of the secondary coil on the high voltage side. The coil spring electrically conducts the high voltage terminal with a terminal portion of a tip end of the insulator portion of the sparkplug. The plug cap has a circumferential mount portion, which is in a substantially cylindrical shape, attached to an outer circumferential periphery of the cap mount portion. The cap mount portion has a substantially annular space communicating with the inner gap in the coil case. The substantially annular space is charged with the infilling resin. The circumferential mount portion has a low voltage end on a low voltage side. The substantially annular space has a high voltage end located on the high voltage side with respect to the low voltage end of the circumferential mount portion.

According to another aspect of the present invention, an ignition coil adapted to being connected with a sparkplug via a coil spring and a rubber plug cap, and inserted into a plughole of an engine, the ignition coil including a coil case. The ignition coil further includes primary and secondary coils accommodated in the coil case. One of the coil case and a primary spool of the primary coil extends to define a mount portion in a substantially cylindrical shape on a high voltage side. The mount portion includes a high voltage terminal electrically conductive with the secondary coil. The high voltage terminal is adapted to electrically conducting with the sparkplug via the coil spring. The mount portion has an outer circumferential periphery adapted to being attached to a circumferential portion of the rubber plug cap. The rubber plug cap circumferentially surrounds the high voltage terminal, and is adapted to circumferentially surrounding the coil spring and an insulator portion of the sparkplug. The mount portion has a substantially annular space communicating with an inner gap in the coil case, and charged with an infilling resin. The infilling resin charged in the substantially annular space has a first resin high voltage end located on the high voltage side with respect to a low voltage end of the circumferential portion of the rubber plug cap on a low voltage side.

According to another aspect of the present invention, an ignition coil adapted to being connected with a sparkplug and inserted into a plughole of an engine, the ignition coil including a coil case. The ignition coil further includes primary and secondary coils accommodated in the coil case. One of the coil case and a primary spool of the primary coil extends to define a mount portion in a substantially cylindrical shape on a high voltage side. The mount portion includes a high voltage terminal electrically conductive with the secondary coil. The ignition coil further includes a coil spring adapted to electrically conducting the high voltage terminal with the sparkplug. The ignition coil further includes a rubber plug cap having a circumferential portion attached to an outer circumferential periphery of the mount portion. The rubber plug cap circumferentially surrounds the high voltage terminal and the coil spring, and is adapted to circumferentially surrounding an insulator portion of the sparkplug. The mount portion has a substantially annular space communicating with an inner gap in the coil case, and charged with an infilling resin. The infilling resin charged in the substantially annular space has a first resin high voltage end located on the high voltage side with respect to a low voltage end of the circumferential portion of the rubber plug cap on a low voltage side.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
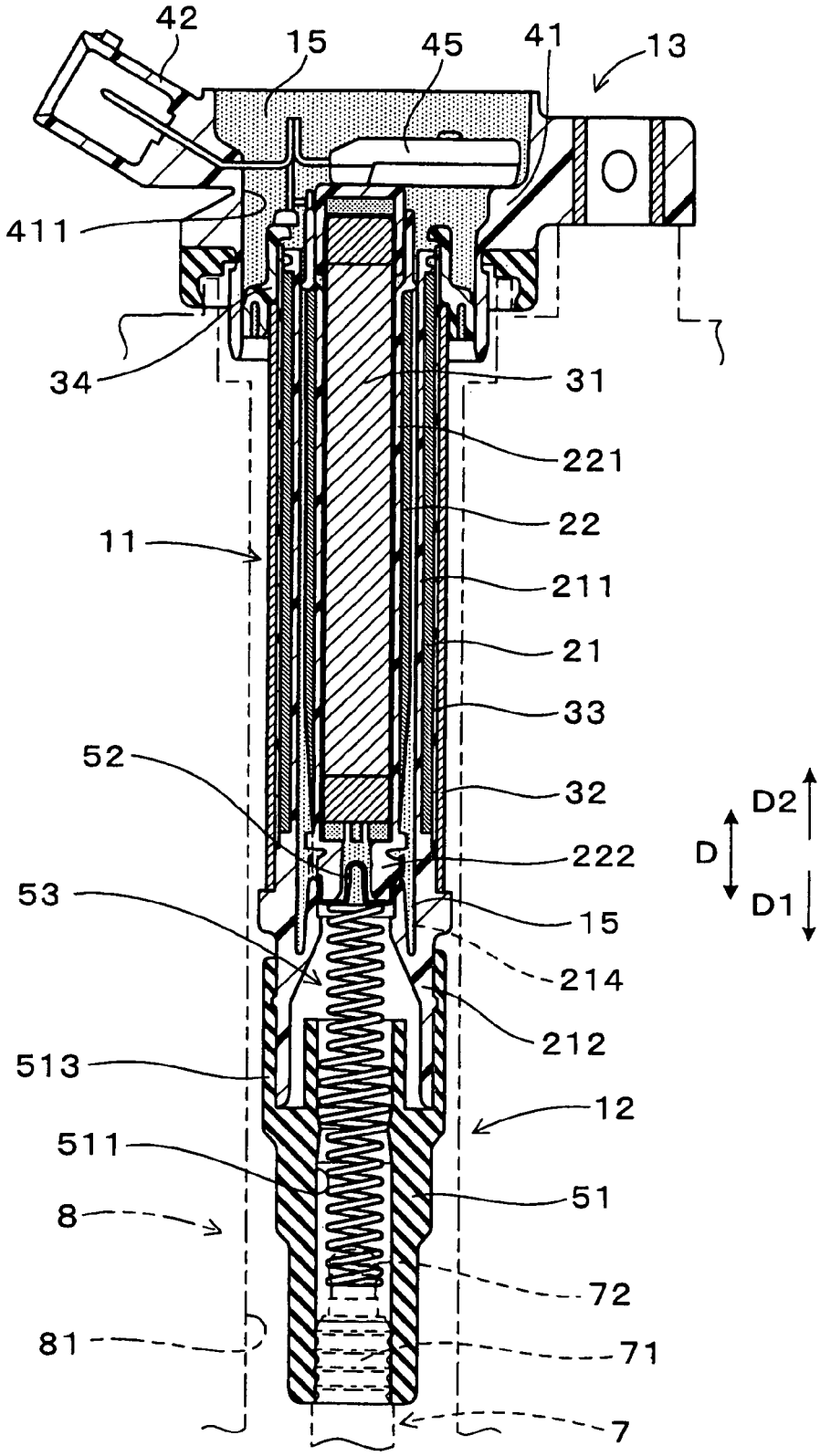
FIG. 1 is a sectional view showing an ignition coil according to a first embodiment.

In this embodiment, as shown in FIG. 1, an ignition coil 1 includes a coil main body 11 and a plug mount portion 12. The coil main body 11 includes a coil case 33 accommodating a primary coil 21 and a secondary coil 22. The plug mount portion 12 is provided to an end of a high voltage side D1 of the coil main body 11. The coil case 33 has therein a gap charged with infilling resin 15. The ignition coil 1 has a stick-type structure. Specifically, the plug mount portion 12 and the coil main body 11 are inserted into a plughole 81 of a cylinder head cover 8 of the engine.

Figure 2:
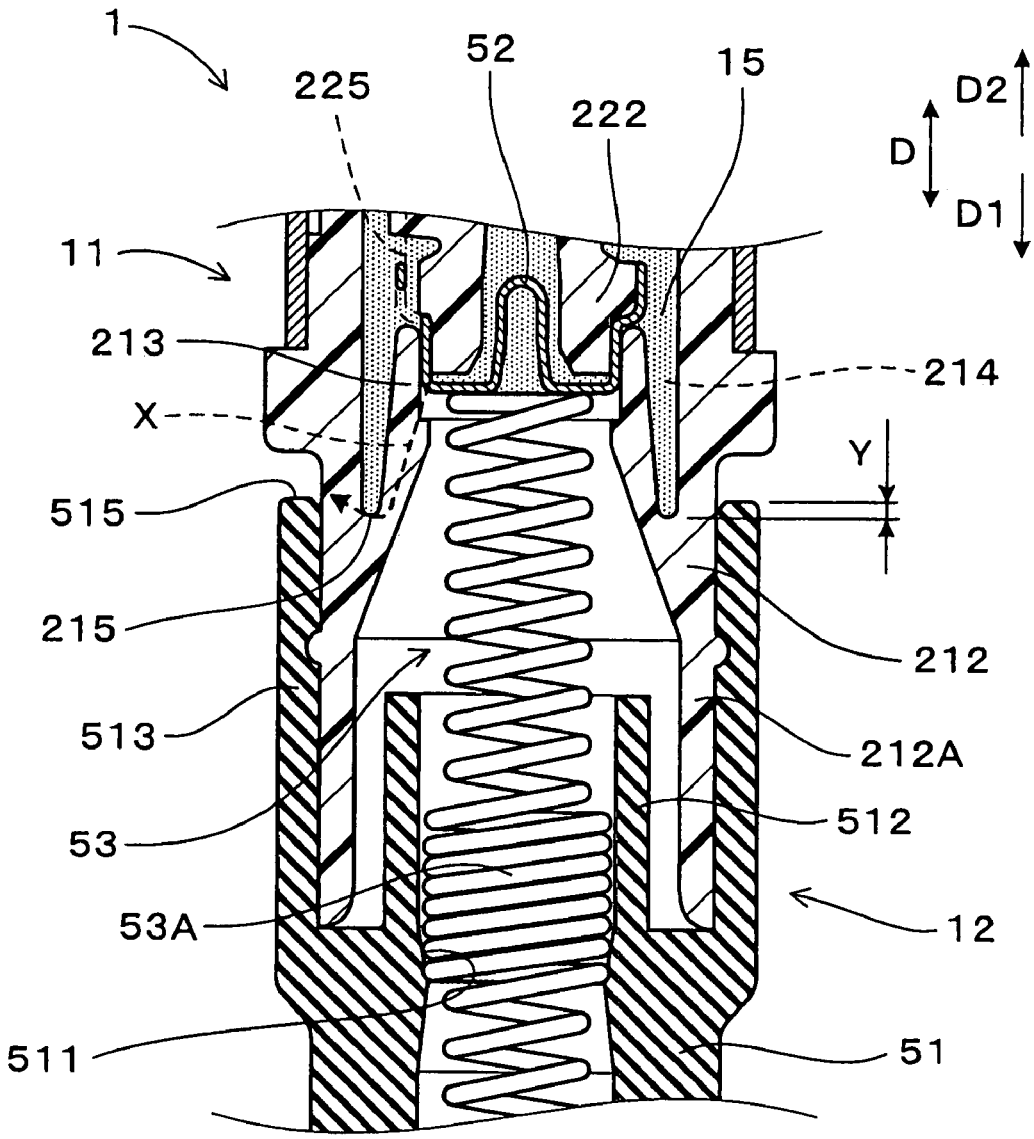
FIG. 2 is a sectional view showing a plug mount portion of the ignition coil according to the first embodiment.

As shown in FIG. 2, a substantially cylindrical cap mount portion 212 is extended from a primary spool 211 of the primary coil 21. The plug mount portion 12 is constructed by providing a plug cap 51, which is formed of rubber, to the cap mount portion 212. The plug cap 51 has a fitting hole 511 into which an insulator portion 71 of a sparkplug 7 is fitted. A high voltage terminal 52 and a coil spring 53 are provided in the fitting hole 511 of the plug cap 51. The high voltage terminal 52 is electrically conducted with a high voltage winding end 225 of the secondary coil 22. The coil spring 53 electrically conducts the high voltage terminal 52 with a terminal portion 72 formed in a tip end of the insulator portion 71 of the sparkplug 7 (FIG. 1).

The plug cap 51 has a substantially cylindrical circumferential mount portion 513 attached to the outer circumferential periphery of the cap mount portion 212. The cap mount portion 212 has an annular space 214, which is in a substantially annular shape, communicating with the gap in the coil case 33. The substantially annular space 214 is charged with the infilling resin 15. The annular space 214 has a high voltage end 215, which located on the high voltage side D1 relative to a low voltage end 515 of the circumferential mount portion 513. The high voltage end 215 is charged with the infilling resin 15 to define a first resin high voltage end 215. Therefore, the first resin high voltage end 215 is located on the high voltage side D1 relative to the low voltage end 515 of the circumferential mount portion 513.

As follows, the ignition coil 1 is described with reference to FIGS. 1 to 2. Referring to FIG. 1, the ignition coil 1 has the plug mount portion 12 in an axial end of the coil main body 11 on the high voltage side D1. The ignition coil 1 has a connector portion 13 in another axial end of the coil main body 11 on the low voltage side D2. The ignition coil 1 is electrically connected with an external electronic control unit (ECU) of the engine via the connector portion 13. The coil main body 11 and the plug mount portion 12 are inserted into the plughole 81, and the connector portion 13 is located outside the plughole 81, when the ignition coil is mounted.

The primary coil 21 is constructed by winding a wire, which is applied with electrically insulative coating, around the outer circumferential periphery of the primary spool 211. The primary spool 211 is, for example, formed of thermoplastic resin to have a substantially annular cross section. The secondary coil 22 is constructed by winding a wire, which is applied with electrically insulative coating, around the outer circumferential periphery of the secondary spool 221. The secondary spool 221 is, for example, formed of thermoplastic resin to have a substantially annular cross section. The secondary winding is smaller than the primary winding in diameter. The number of winding of the wire to construct the secondary winding around the secondary spool 221 is greater than the number of winding of the wire to construct the primary winding around the primary spool 211.

Referring to FIG. 1, a substantially bar-shaped center core 31, which is formed of a magnetic material, is provided on the radially inner side of the primary coil 21 and the secondary coil 22. A substantially cylindrical outer core 32, which is formed of a magnetic material, is provided on the radially outer side of the primary coil 21 and the secondary coil 22. In this example, the secondary coil 22 is arranged on the radially inner side of the primary coil 21. The center core 31 is arranged on the radially inner side of the secondary coil 22. The coil case 33 is in a substantially cylindrical shape having a thin wall. The coil case 33 is provided between the outer circumferential periphery of the primary coil 21 and the outer core 32. In this example, the center core 31 is formed by stacking substantially plate-shaped electromagnetic plates such as silicon steel plates with respect to the radial direction of the ignition coil 1 to have a substantially circular cross section. In this example, the outer core 32 is formed by radially stacking electromagnetic plates such as silicon steel plates along the outer circumferential periphery to have a substantially cylindrical cross section.

Referring to FIG. 2, the cap mount portion 212 of the plug mount portion 12 includes a mount body portion 212A and a support portion 213. The mount body portion 212A is connected to the circumferential mount portion 513 of the plug cap 51. The support portion 213 is formed on the radially inner side of the mount body portion 212A to support the outer circumferential periphery of the high voltage terminal 52. The annular space 214 is formed between the mount body portion 212A and the support portion 213. The annular space 214 is recessed toward the low voltage portion D2 with respect to the axial direction D. The high voltage end 215 of the annular space 214, i.e., the first resin high voltage end 215 is located at an axial distance Y from the low voltage end 515 of the circumferential mount portion 513. In this example, the axial distance Y is 0.8±0.4 mm.

A spring support portion 512 protrudes from the plug cap 51 toward the low voltage side D2 with respect to the axial direction D. In this example, the coil spring 53 has an intermediate portion 53A supported by the spring support portion 512 on the radially inner side of the circumferential mount portion 513. In this example, the high voltage terminal (secondary terminal) 52 is electrically connected with the high voltage winding end 225 of the secondary winding. A terminal mount portion 222 is provided to the end of the secondary spool 221 on the high voltage side D1. The support portion 213 is formed on the radially inner side of the cap mount portion 212 of the primary spool 211. The high voltage terminal 52 is interposed between the terminal mount portion 222 and the support portion 213. The high voltage winding end 225 of the secondary winding is electrically conducted with the terminal portion 72 of the sparkplug 7 via the high voltage terminal 52 and the coil spring 53. Referring to FIG. 1, the insulator portion 71 of the sparkplug 7 is inserted into the fitting hole 511 of the plug cap 51. The insulator portion 71 is fixed to the cylinder head cover 8 of the engine in a condition where the terminal portion 72 in the tip end of the insulator portion 71 is in contact with the high voltage terminal 531 of the coil spring 53.

The connector portion 13 is constructed by providing an igniter 45 in a connector case 41, which is formed of, for example, thermoplastic, for supplying electricity to the primary winding. A connector joint portion 42 radially extends from the connector portion 13. The igniter 45 has multiple conductive pins, which are respectively conduced with multiple conductive pins, which are insert-molded in the connector joint portion 42. The coil main body 11 is fitted into a fitting hole 411 of the connector case 41 via an engage member 34, which is formed of, for example, thermoplastic resin. The igniter 45 includes a power supply circuit for supplying electric power to the primary winding. The igniter 45 further includes an ion current detection circuit for detecting an ion current flowing in the secondary winding through a pair of electrodes of the sparkplug 7.

The inner gap in the ignition coil 1 is charged with the infilling resin 15. In this example, the infilling resin 15 is thermosetting resin such as epoxy resin. The infilling resin 15 is formed by assembling the components of the ignition coil 1, vacuuming the inner gap of the ignition coil 1, charging resin such as epoxy resin being in a liquid condition into the vacuum gap, and solidifying the epoxy resin. The infilling resin 15 is charged in the gap defined among the coil case 33, the connector portion 13, the primary spool 211 including the cap mount portion 212, the high voltage terminal 52, and the like of the ignition coil 1. Referring to FIG. 2, the resin is charged into the annular space 214 through the gap between the primary coil 21 and the secondary coil 22, and formed to be the infilling resin 15.

The ECU transmits a pulse-shaped spark-generating signal to supply electricity to the primary winding, so that the center core 31 and the outer core 32 form therebetween a magnetic field. The ECU terminates the electricity supplied to the primary winding, so that the center core 31 and the outer core 32 form therebetween an inductive magnetic field opposite to the magnetic field. The inductive magnetic field generates induced high-voltage electromotive force (counter electromotive force) in the secondary wiring, so that the pair of electrodes of the sparkplug 7 of the ignition coil 1 sparks.

In this example of the ignition coil 1, the plug mount portion 12 includes the cap mount portion 212, to which the plug cap 51 formed of rubber is mounted. The cap mount portion 212 has the annular space 214 charged with the infilling resin 15. The annular space 214 has the high voltage end 215, i.e., the first resin high voltage end 215, which is located on the high voltage side D1 relative to the low voltage end 515 of the circumferential mount portion 513.

Referring to FIG. 2, an insulation distance (creepage distance) X is defined for restricting electric leakage from the high voltage terminal 52 to the plughole 81. Specifically, the path of the insulation distance X extends from the high voltage terminal 52 toward the high voltage side D1 on the radially inner side of the annular space 214 charged with the infilling resin 15. Subsequently, the path of the insulation distance X further extends toward the low voltage side D2 after passing around the high voltage end 215 of the annular space 214 charged with the infilling resin 15. Thus, the path of the insulation distance X further extends to the low voltage end 515 of the plug cap 51. In this structure, the insulation distance X can be sufficiently secured for restricting electric leakage from the high voltage terminal 52 to the plughole 81 in the ignition coil 1 having the stick type structure. Thus, high-voltage electricity in the high voltage terminal 52 can be effectively restricted from leaking to the plughole 81. Therefore, withstand voltage of the ignition coil 1 can be enhanced.

As unillustrated, the cap mount portion 212 may be formed by extending the coil case 33. In this structure, the cap mount portion 212 may be formed integrally with the coil case 33. Alternatively, in this structure, the cap mount portion 212 may be formed separately from the coil case 33, and the cap mount portion 212 may be connected with the coil case 33.

Second Embodiment

Figure 3:
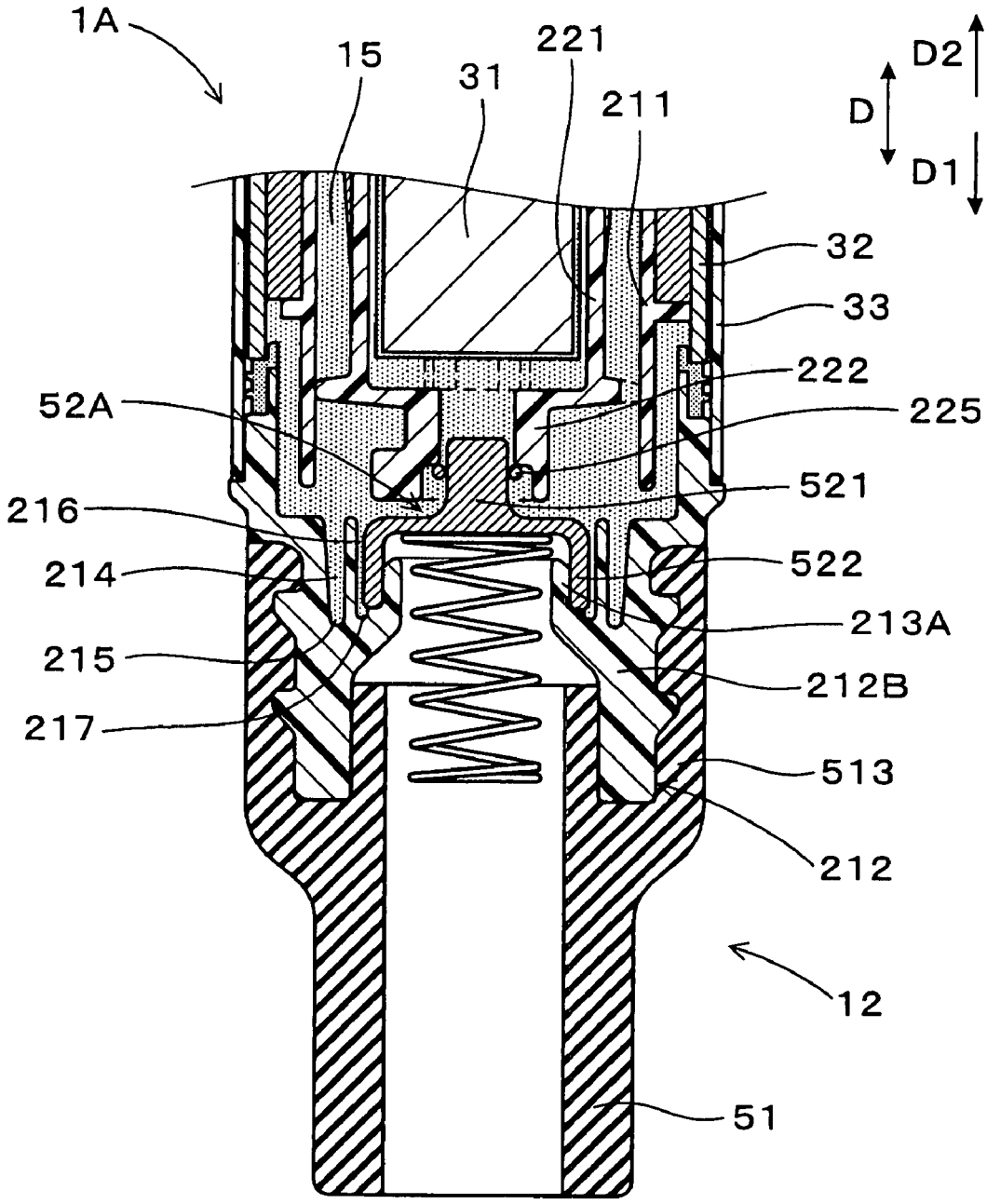
FIG. 3 is a sectional view showing a plug mount portion of the ignition coil according to a second embodiment.

As shown in FIG. 3, in this embodiment, an ignition coil 1A is provided with a high voltage terminal 52A, which is in a shape different from that of the high voltage terminal 52 in the first embodiment. The ignition coil 1A also has a structure to restrict electric leakage from the high voltage terminal 52A to the plughole 81. The high voltage terminal 52A includes a terminal connecting portion 521 and a terminal cylindrical portion 522. The terminal connecting portion 521 connects with the high voltage winding end 225 of the secondary coil 22. The terminal cylindrical portion 522 is in a substantially cylindrical shape to extend from the terminal connecting portion 521. The terminal mount portion 222 of the secondary spool 221 surrounds the terminal connecting portion 521. In this example, the cap mount portion 212 includes a mount body portion 212B and a support portion 213A. The mount body portion 212B is connected to the circumferential mount portion 513 of the plug cap 51. The support portion 213A is formed on the radially inner side of the mount body portion 212B to support the inner circumferential periphery of the terminal cylindrical portion 522 of the high voltage terminal 52A.

A radially inner space 216 is located on the radially inner side of the annular space 214 in the cap mount portion 212. The radially inner space 216 is radially opposed to the outer circumferential periphery of the terminal cylindrical portion 522 of the high voltage terminal 52A. The radially inner space 216 is an annular space extending circumferentially throughout the terminal cylindrical portion 522 of the high voltage terminal 52A. The radially inner space 216 is charged with the infilling resin 15 integrally with the infilling resin charged in the annular space 214 through the gap in the ignition coil. The annular space 214 has the high voltage end 215 charged with the infilling resin 15. The high voltage end 215 is located on the high voltage side D1 relative to a high voltage end 217 of the radially inner space 216 charged with the infilling resin 15.

The high voltage end 217 of the radially inner space 216 is charged with the infilling resin 15 to define a second resin high voltage end 217. The first resin high voltage end 215 is located on the high voltage side D1 relative to the second resin high voltage end 217 of the radially inner space 216 charged with the infilling resin 15.

In this example, the radially inner space 216 and the annular space 214 are charged with resin, and are located on the radially outer side of the high voltage terminal 52A. In this structure, electricity in the high voltage terminal 52A can be also effectively restricted from leaking to the plughole 81. In this example of the ignition coil 1A, the structure other than the above feature is similar to that in the first embodiment, so that the ignition coil 1A in this embodiment is capable of producing an effect similarly to the first embodiment.

The above structures of the embodiments can be combined as appropriate.

Various modifications and alternations may be diversely made to the above embodiments without departing from the spirit of the present invention.

What is claimed is:

1. An ignition coil for a sparkplug of an engine, the ignition coil comprising:

a coil main body including a coil case accommodating a primary coil and a secondary coil; and a plug mount portion provided to a high voltage end of the coil main body on a high voltage side, wherein the coil case has an inner gap charged with an infilling resin, the plug mount portion and the coil main body are inserted into a plughole of the engine, the plug mount portion has a cap mount portion in a substantially cylindrical shape extending from a primary spool of the primary coil or the coil case, the cap mount portion is connected with a plug cap, which is formed of rubber, having a fitting hole into which an insulator portion of the sparkplug is inserted together with a high voltage terminal and a coil spring, the high voltage terminal is electrically conductive with a high voltage winding end of a winding of the secondary coil on the high voltage side, the coil spring electrically conducts the high voltage terminal with a terminal portion of a tip end of the insulator portion of the sparkplug, the plug cap has a circumferential mount portion, which is in a substantially cylindrical shape, attached to an outer circumferential periphery of the cap mount portion, the cap mount portion has a substantially annular space communicating with the inner gap in the coil case, the substantially annular space is charged with the infilling resin, and the circumferential mount portion has a low voltage end on a low voltage side, and the substantially annular space has a high voltage end located on the high voltage side with respect to the low voltage end of the circumferential mount portion.

2. The ignition coil according to claim 1, wherein the cap mount portion includes a mount body portion connected with the circumferential mount portion, the cap mount portion further includes a support portion on a radially inner side of the mount body portion to support an outer circumferential periphery of the high voltage terminal, and the mount body portion and the support portion therebetween define the substantially annular space.

3. The ignition coil according to claim 1, wherein the high voltage end of the substantially annular space is located at an axial distance from the low voltage end of the circumferential mount portion with respect to an axial direction, and the axial distance is 0.8±0.4 mm.

4. The ignition coil according to claim 1, wherein the high voltage terminal includes a terminal connecting portion connecting with the high voltage winding end of the secondary coil, the high voltage terminal further includes a terminal cylindrical portion, which is in a substantially cylindrical shape, extending from the terminal connecting portion, the cap mount portion includes a mount body portion connected with the circumferential mount portion, the cap mount portion further includes a support portion formed on a radially inner side of the mount body portion to support an inner circumferential periphery of the terminal cylindrical portion of the high voltage terminal, the cap mount portion defines a radially inner space on the radially inner side of the substantially annular space, the radially inner space is radially opposed to an outer circumferential periphery of the terminal cylindrical portion of the high voltage terminal, the radially inner space is charged with the infilling resin, the radially inner space has a high voltage end on the high voltage side, and the high voltage end of the substantially annular space is located on the high voltage side with respect to the high voltage end of the radially inner space.

5. An ignition coil adapted to being connected with a sparkplug via a coil spring and a plug cap, which is electrically insulative, and inserted into a plughole of an engine, the ignition coil comprising:

a coil case; and primary and secondary coils accommodated in the coil case, wherein one of the coil case and a primary spool of the primary coil extends to define a mount portion in a substantially cylindrical shape on a high voltage side, the mount portion including a high voltage terminal electrically conductive with the secondary coil, the high voltage terminal is adapted to electrically conducting with the sparkplug via the coil spring, the mount portion has an outer circumferential periphery adapted to being attached to a circumferential portion of the plug cap, the plug cap circumferentially surrounds the high voltage terminal, and is adapted to circumferentially surrounding the coil spring and an insulator portion of the sparkplug, the mount portion has a substantially annular space communicating with an inner gap in the coil case, and charged with an infilling resin, and the infilling resin charged in the substantially annular space has a first resin high voltage end located on the high voltage side with respect to a low voltage end of the circumferential portion of the plug cap on a low voltage side.

6. The ignition coil according to claim 5, wherein the mount portion includes a mount body portion connected with the circumferential portion, the mount portion further includes a support portion on a radially inner side of the mount body portion to support an outer circumferential periphery of the high voltage terminal, and the mount body portion and the support portion therebetween define the substantially annular space charged with the infilling resin.

7. The ignition coil according to claim 5, wherein the first resin high voltage end is located at an axial distance from the low voltage end of the circumferential portion with respect to an axial direction of the coil case, and the axial distance is 0.8±0.4 mm.

8. The ignition coil according to claim 5, wherein the high voltage terminal includes a terminal connecting portion electrically conductive with the secondary coil, the high voltage terminal further includes a terminal cylindrical portion, which is in a substantially cylindrical shape, extending from the terminal connecting portion, the mount portion includes a mount body portion connected with the circumferential portion of the plug cap, the mount portion further includes a support portion formed on a radially inner side of the mount body portion to support an inner circumferential periphery of the terminal cylindrical portion of the high voltage terminal, the mount portion defines a radially inner space on the radially inner side of the substantially annular space charged with the infilling resin, the radially inner space is radially opposed to an outer circumferential periphery of the terminal cylindrical portion of the high voltage terminal, the radially inner space is charged with the infilling resin to define a second resin high voltage end on the high voltage side, and the first resin high voltage end is located on the high voltage side with respect to the second resin second resin high voltage end.

9. The ignition coil according to claim 5, wherein the mount portion and the coil case are adapted to being inserted in a plughole of the engine.

10. The ignition coil according to claim 5, wherein the plug cap is formed of rubber.

11. An ignition coil adapted to being connected with a sparkplug and inserted into a plughole of an engine, the ignition coil comprising:

a coil case; and primary and secondary coils accommodated in the coil case, wherein one of the coil case and a primary spool of the primary coil extends to define a mount portion in a substantially cylindrical shape on a high voltage side, the mount portion including a high voltage terminal electrically conductive with the secondary coil, a coil spring adapted to electrically conducting the high voltage terminal with the sparkplug, a plug cap being electrically insulative and having a circumferential portion attached to an outer circumferential periphery of the mount portion, the plug cap circumferentially surrounding the high voltage terminal and the coil spring, and being adapted to circumferentially surrounding an insulator portion of the sparkplug, wherein the mount portion has a substantially annular space communicating with an inner gap in the coil case, and charged with an infilling resin, and the infilling resin charged in the substantially annular space has a first resin high voltage end located on the high voltage side with respect to a low voltage end of the circumferential portion of the plug cap on a low voltage side.

12. The ignition coil according to claim 11, wherein the mount portion and the coil case are adapted to being inserted in a plughole of the engine.

13. The ignition coil according to claim 11, wherein the plug cap is formed of rubber.

14. An ignition coil adapted to being connected with a sparkplug and inserted into a plughole of an engine, the ignition coil comprising:

a coil case; and primary and secondary coils accommodated in the coil case, one of the coil case and a primary spool of the primary coil extending to define a mount portion in a substantially cylindrical shape on a high voltage side, the mount portion including a high voltage terminal electrically conductive with the secondary coil;

a coil spring adapted to electrically conducting the high voltage terminal with the sparkplug; and a plug cap being electrically insulative and having a tubular portion attached to an outer circumferential periphery of the mount portion, the plug cap circumferentially surrounding the high voltage terminal and the coil spring, and being adapted to circumferentially surrounding an insulator portion of the sparkplug, wherein the mount portion has an annular resin portion embedded in the coil case to circumferentially surround the high voltage terminal, and the annular resin portion has a resin high voltage end located on the high voltage side of a low voltage end of the tubular portion of the plug cap on a low voltage side.

* * * * *